US008739538B2

(12) United States Patent
Myers et al.

(10) Patent No.: US 8,739,538 B2
(45) Date of Patent: Jun. 3, 2014

(54) GENERATING ENERGY FROM FLUID EXPANSION

(75) Inventors: Scott R. Myers, Spring Hill, FL (US); David J. Huber, Tequesta, FL (US)

(73) Assignee: General Electric Company, Schenectady, NY (US)

( * ) Notice: Subject to any disclaimer, the term of this patent is extended or adjusted under 35 U.S.C. 154(b) by 469 days.

(21) Appl. No.: 12/790,616

(22) Filed: May 28, 2010

(65) Prior Publication Data

US 2011/0289922 A1 Dec. 1, 2011

(51) Int. Cl.

| | |
|---|---|
| ***F01K 23/06*** | (2006.01) |
| ***F01K 25/00*** | (2006.01) |
| ***F01K 13/00*** | (2006.01) |
| ***F01C 13/00*** | (2006.01) |
| ***F02D 25/00*** | (2006.01) |

(52) U.S. Cl.
USPC ..... 60/670; 60/645; 60/651; 60/671; 290/4 R; 290/4 C; 290/4 D

(58) Field of Classification Search
USPC ..... 60/618, 645–681; 290/52, 4 R, 4 C, 4 D; 415/93–96, 101–103
See application file for complete search history.

(56) References Cited

U.S. PATENT DOCUMENTS

| | | | | |
|---|---|---|---|---|
| 2,276,695 | A | | 3/1942 | Lavarello |
| 2,409,857 | A | | 10/1946 | Hines et al. |
| 2,465,761 | A | | 3/1949 | Staude |
| 2,917,636 | A | | 12/1959 | Skeley et al. |
| 3,035,557 | A | | 5/1962 | Litwinoff et al. |
| 3,060,335 | A | | 10/1962 | Greenwald |
| 3,064,942 | A | | 11/1962 | Martin et al. |
| 3,212,477 | A | | 10/1965 | Hansruedi |
| 3,232,050 | A | * | 2/1966 | Robinson et al. ..... 60/671 |
| 3,439,201 | A | | 4/1969 | Levy et al. |
| 3,530,836 | A | | 9/1970 | Caravatti |
| 3,599,424 | A | | 8/1971 | Yampolsky |
| 3,728,857 | A | * | 4/1973 | Nichols ..... 62/469 |
| 3,830,062 | A | * | 8/1974 | Morgan et al. ..... 60/618 |
| 3,943,443 | A | | 3/1976 | Kimura et al. |
| 3,999,787 | A | | 12/1976 | Park |

(Continued)

FOREIGN PATENT DOCUMENTS

| | | |
|---|---|---|
| DE | 102008019813 | 10/2009 |
| EP | 0 462 724 A1 | 12/1991 |

(Continued)

OTHER PUBLICATIONS

JP 8218816 A (Machine Translation from JPO), http://dossier1.ipdl.inpit.go.jp/AIPN/odse_top_dn.ipdl?N0000=7400.*

(Continued)

*Primary Examiner* — Christopher Jetton
(74) *Attorney, Agent, or Firm* — Fletcher Yoder P. C.

(57) ABSTRACT

An apparatus includes an electric generator having a stator and a rotor. A first turbine wheel is coupled to a first end of the rotor to rotate at the same speed as the rotor. A second turbine wheel is coupled to a second end of the rotor opposite the first end, and configured to rotate at the same speed as the rotor. The first and second turbine wheels may rotate in response to expansion of a working fluid flowing from an inlet side to an outlet side of the turbine wheels.

24 Claims, 7 Drawing Sheets

(56) References Cited

U.S. PATENT DOCUMENTS

| | | | | | |
|---|---|---|---|---|---|
| 4,033,141 | A | * | 7/1977 | Gustafsson | 62/238.4 |
| 4,170,435 | A | | 10/1979 | Swearingen | |
| 4,260,914 | A | | 4/1981 | Hertrich | |
| 4,262,636 | A | | 4/1981 | Augsburger | |
| 4,301,375 | A | | 11/1981 | Anderson | |
| 4,341,151 | A | | 7/1982 | Sakamoto | |
| 4,358,697 | A | | 11/1982 | Liu et al. | |
| 4,362,020 | A | | 12/1982 | Meacher et al. | |
| 4,363,216 | A | * | 12/1982 | Bronicki | 60/657 |
| 4,415,024 | A | | 11/1983 | Baker | |
| 4,463,567 | A | * | 8/1984 | Amend et al. | 60/671 |
| 4,472,355 | A | | 9/1984 | Hickam et al. | |
| 4,479,354 | A | * | 10/1984 | Cosby | 60/670 |
| 4,512,851 | A | | 4/1985 | Swearingen | |
| 4,544,855 | A | | 10/1985 | Prenner et al. | |
| 4,553,397 | A | | 11/1985 | Wilensky | |
| 4,555,637 | A | | 11/1985 | Irvine | |
| 4,558,228 | A | | 12/1985 | Larjola | |
| 4,635,712 | A | | 1/1987 | Baker et al. | |
| 4,659,969 | A | | 4/1987 | Stupak | |
| 4,738,111 | A | | 4/1988 | Edwards | |
| 4,740,711 | A | | 4/1988 | Sato et al. | |
| 4,748,814 | A | | 6/1988 | Tanji et al. | |
| 4,760,705 | A | * | 8/1988 | Yogev et al. | 60/651 |
| 4,838,027 | A | * | 6/1989 | Rosado et al. | 60/671 |
| 4,996,845 | A | * | 3/1991 | Kim | 60/618 |
| 5,000,003 | A | | 3/1991 | Wicks | |
| 5,003,211 | A | | 3/1991 | Groom | |
| 5,083,040 | A | | 1/1992 | Whitford et al. | |
| D325,080 | S | | 3/1992 | Wortham | |
| 5,107,682 | A | | 4/1992 | Cosby | |
| 5,241,425 | A | | 8/1993 | Sakamoto et al. | |
| 5,263,816 | A | | 11/1993 | Weimer et al. | |
| 5,285,123 | A | | 2/1994 | Kataoka et al. | |
| 5,315,197 | A | | 5/1994 | Meeks et al. | |
| 5,351,487 | A | | 10/1994 | Abdelmalek | |
| 5,481,145 | A | | 1/1996 | Canders et al. | |
| 5,514,924 | A | | 5/1996 | McMullen et al. | |
| 5,531,073 | A | | 7/1996 | Bronicki et al. | |
| 5,559,379 | A | * | 9/1996 | Voss | 310/63 |
| 5,627,420 | A | | 5/1997 | Rinker et al. | |
| 5,640,064 | A | | 6/1997 | Boyd, Jr. et al. | |
| 5,668,429 | A | | 9/1997 | Boyd, Jr. et al. | |
| 5,671,601 | A | | 9/1997 | Amir et al. | |
| 5,672,047 | A | | 9/1997 | Birkholz | |
| 5,743,094 | A | | 4/1998 | Amir et al. | |
| 5,780,932 | A | | 7/1998 | Laffont | |
| 5,818,242 | A | | 10/1998 | Grzybowski | |
| 5,852,338 | A | | 12/1998 | Boyd, Jr. et al. | |
| 5,894,182 | A | | 4/1999 | Saban et al. | |
| 5,911,453 | A | | 6/1999 | Boyd, Jr. et al. | |
| 5,942,829 | A | | 8/1999 | Huynh | |
| 5,990,588 | A | | 11/1999 | Kliman et al. | |
| 5,994,804 | A | | 11/1999 | Grennan et al. | |
| 6,002,191 | A | | 12/1999 | Saban | |
| 6,018,207 | A | | 1/2000 | Saban et al. | |
| 6,087,744 | A | | 7/2000 | Glauning | |
| 6,088,905 | A | | 7/2000 | Boyd, Jr. et al. | |
| 6,130,494 | A | | 10/2000 | Schob | |
| 6,148,967 | A | | 11/2000 | Huynh | |
| 6,167,703 | B1 | | 1/2001 | Rumez et al. | |
| 6,177,735 | B1 | | 1/2001 | Chapman et al. | |
| 6,191,511 | B1 | | 2/2001 | Zysset | |
| 6,223,417 | B1 | | 5/2001 | Saban et al. | |
| 6,250,258 | B1 | | 6/2001 | Liebig | |
| 6,259,166 | B1 | | 7/2001 | Tommer | |
| 6,270,309 | B1 | | 8/2001 | Ghetzler et al. | |
| 6,304,015 | B1 | | 10/2001 | Filatov et al. | |
| 6,324,494 | B1 | | 11/2001 | Saban | |
| 6,325,142 | B1 | | 12/2001 | Bosley et al. | |
| 6,343,570 | B1 | | 2/2002 | Schmid et al. | |
| 6,388,356 | B1 | | 5/2002 | Saban | |
| D459,796 | S | | 7/2002 | Moreno | |
| 6,437,468 | B2 | | 8/2002 | Stahl et al. | |
| 6,465,924 | B1 | | 10/2002 | Maejima | |
| 6,504,337 | B1 | | 1/2003 | Saban et al. | |
| 6,598,397 | B2 | | 7/2003 | Hanna et al. | |
| 6,663,347 | B2 | | 12/2003 | Decker et al. | |
| 6,664,680 | B1 | | 12/2003 | Gabrys | |
| 6,692,222 | B2 | | 2/2004 | Prinz et al. | |
| 6,700,258 | B2 | | 3/2004 | McMullen et al. | |
| 6,727,617 | B2 | | 4/2004 | McMullen et al. | |
| 6,777,847 | B1 | | 8/2004 | Saban et al. | |
| 6,794,780 | B2 | | 9/2004 | Silber et al. | |
| 6,856,062 | B2 | | 2/2005 | Heiberger et al. | |
| 6,876,194 | B2 | | 4/2005 | Lin et al. | |
| 6,880,344 | B2 | | 4/2005 | Radcliff et al. | |
| 6,897,587 | B1 | | 5/2005 | McMullen et al. | |
| 6,900,553 | B2 | | 5/2005 | Gozdawa | |
| 6,934,666 | B2 | | 8/2005 | Saban et al. | |
| 6,960,840 | B2 | | 11/2005 | Willis et al. | |
| 6,967,461 | B1 | | 11/2005 | Markunas et al. | |
| 6,986,251 | B2 | | 1/2006 | Radcliff et al. | |
| 7,019,412 | B2 | | 3/2006 | Ruggieri et al. | |
| 7,042,118 | B2 | | 5/2006 | McMullen et al. | |
| 7,047,744 | B1 | | 5/2006 | Robertson et al. | |
| 7,075,399 | B2 | | 7/2006 | Saban et al. | |
| 7,125,223 | B2 | | 10/2006 | Turnquist et al. | |
| 7,146,813 | B2 | * | 12/2006 | Brasz et al. | 60/651 |
| 7,208,854 | B1 | | 4/2007 | Saban et al. | |
| 7,225,621 | B2 | | 6/2007 | Bronicki et al. | |
| 7,436,922 | B2 | | 10/2008 | Peter | |
| 7,581,921 | B2 | | 9/2009 | Bagepalli et al. | |
| 7,594,399 | B2 | | 9/2009 | Lehar et al. | |
| 7,638,892 | B2 | * | 12/2009 | Myers | 290/52 |
| 8,375,716 | B2 | | 2/2013 | Ramaswamy et al. | |
| 2003/0074165 | A1 | | 4/2003 | Saban et al. | |
| 2004/0020206 | A1 | * | 2/2004 | Sullivan et al. | 60/670 |
| 2004/0027011 | A1 | | 2/2004 | Bostwick et al. | |
| 2004/0189429 | A1 | | 9/2004 | Saban et al. | |
| 2005/0093391 | A1 | | 5/2005 | McMullen et al. | |
| 2005/0262848 | A1 | | 12/2005 | Held | |
| 2006/0185366 | A1 | | 8/2006 | Kahlbau et al. | |
| 2007/0018516 | A1 | | 1/2007 | Pal et al. | |
| 2007/0056285 | A1 | | 3/2007 | Brewington | |
| 2007/0063594 | A1 | | 3/2007 | Huynh | |
| 2007/0200438 | A1 | | 8/2007 | Kaminski et al. | |
| 2007/0204623 | A1 | | 9/2007 | Rollins | |
| 2008/0103632 | A1 | | 5/2008 | Saban et al. | |
| 2008/0224551 | A1 | | 9/2008 | Saban et al. | |
| 2008/0246281 | A1 | | 10/2008 | Agrawal et al. | |
| 2008/0246373 | A1 | | 10/2008 | Filatov | |
| 2008/0250789 | A1 | | 10/2008 | Myers et al. | |
| 2008/0252077 | A1 | | 10/2008 | Myers | |
| 2008/0252078 | A1 | | 10/2008 | Myers et al. | |
| 2009/0004032 | A1 | | 1/2009 | Kaupert | |
| 2009/0126371 | A1 | | 5/2009 | Bujac et al. | |
| 2009/0217693 | A1 | * | 9/2009 | Kikuchi et al. | 62/402 |
| 2009/0301078 | A1 | | 12/2009 | Chillar et al. | |
| 2010/0071368 | A1 | * | 3/2010 | Kaplan et al. | 60/651 |
| 2011/0138809 | A1 | | 6/2011 | Ramaswamy et al. | |
| 2011/0289922 | A1 | | 12/2011 | Myers et al. | |

FOREIGN PATENT DOCUMENTS

| | | | | | |
|---|---|---|---|---|---|
| EP | 1 905 948 | A1 | | 4/2008 | |
| GB | 2 225 813 | A | | 6/1990 | |
| GB | 2405450 | | | 3/2005 | |
| JP | 55 075502 | A | | 6/1980 | |
| JP | 57068507 | A | * | 4/1982 | F01K 25/10 |
| JP | 63129839 | | | 6/1988 | |
| JP | 63-277443 | A | | 11/1988 | |
| JP | 63277443 | | | 11/1988 | |
| JP | 3 271507 | A | | 12/1991 | |
| JP | 8 218816 | A | | 8/1996 | |
| JP | 08218816 | A | * | 8/1996 | |
| JP | 9 112207 | A | | 4/1997 | |
| JP | 2001078390 | | | 3/2001 | |
| JP | 2007 127060 | A | | 5/2007 | |
| JP | 2007-127060 | A | | 5/2007 | |
| WO | 93/01397 | A1 | | 1/1993 | |
| WO | WO03100946 | | | 12/2003 | |

(56) References Cited

FOREIGN PATENT DOCUMENTS

| | | | |
|---|---|---|---|
| WO | 2007/088194 | A2 | 8/2007 |
| WO | WO2008061271 | | 5/2008 |
| WO | 2008/090628 | A1 | 7/2008 |

OTHER PUBLICATIONS

International Search Report issued in connection with PCT/US2001/036638; Sep. 1, 2011.
International Search Report issued in connection with PCT/US2001/037710; Oct. 4, 2011.
International Search Report issued in connection with PCT/US2011/037710, Oct. 4, 2011.
European Office Action issued in connection with EP Application No. 08 745 761.0, Jan. 1, 2011.
GE Oil & Gas, "Turboexpander-Generatorsfor Natural Gas Applications," [online], <http://www .ge-energy.com/businesses/geoilandgas/en/literalure/en/downloads/turbo_generators.pdf>, 7 pages, retrieved May 19, 2010.
Hawkins, Larry et al., "Development of an AMB Energy Storage Flywheel for Industrial Applications," in International Symposium on Magnetic Suspension Technology, Fukoka, Japan, Oct. 2003, 7 pages.
Hawkins, Lawrence A. et al., "Analysis and Testing of a Magnetic Bearing Energy Storage Flywheel with Gain-Scheduled, Mimo Control," Proceedings of ASME Turboexpo 2000, Munich, Germany, May 8-11, 2000, pp. 1-8.
Hawkins, Lawrence A. et al., "Application of Permanent Magnet Bias Magnetic Bearings to an Energy Storage Flywheel," Fifth Symposium on Magnetic Suspension Technology, Santa Barbara, CA, Dec. 1-3, 1999, pp. 1-15.
Huynh, Co et al., "Flywheel Energy Storage System for Naval Applications," GT 2006-90270, Proceedings of GT 2006 ASME Turbo Expo 2006: Power for Land, Sea & Air, Barcelona, Spain, May 8-11, 2006, pp. 1-9.
International Preliminary Report on Patentability issued in International Application No. PCT/US2008/060227; Jun. 17, 2009; 10 pages.
International Preliminary Report on Patentability issued in International Application No. PCT/US2008/057082 on Mar. 16, 2009; 10 pages.
International Search Report and Written Opinion of the International Searching Authority issued in corresponding International Application No. PCT/US2008/060227 on Oct. 28, 2008; 8 pages.
International Search Report and Written Opinion of the International Searching Authority issued in International Application No. PCT/US2008/057082 on Jul. 8, 2008, 8 pages.
International Search Report for PCT/US2008/060324 dated Jan. 9, 2010.
Johnson Controls Inc. "Model YMC2 Magnetic Bearing Centrifugal Liquid Chillers Design Level A," 2010, 54 pages.
McMullen, Patrick et al., "Flywheel Energy Storage System with AMB 'sand Hybrid Backup Bearings," Tenth International Symposium on Magnetic Bearings, Martigny, Switzerland, Aug. 21-23, 2006,6pages.
McMullen, Patrick T. et al., "Design and Development of a 100 KW Energy Storage Flywheel for UPS and Power Conditioning Applications," 241 h International PCIM Conference, Nuremberg, Germany, May 20-22, 2003, 6 pages.
United States Patent Office's prosecution file for U.S. Appl. No. 11/524,690, 192 pages.
United States Patent Office's prosecution file for U.S. Appl. No. 12/049,117, 135 pages.
York International Service Instructions for Liquid Cooled Optispeed Compressor Drive, 2004, 52 pages.
United States Patent Office's prosecution file for U.S. Appl. No. 11/735,849; 127 pages.

* cited by examiner

GENERATING ENERGY FROM FLUID EXPANSION

BACKGROUND

This document relates to the operation of a fluid expansion system, including some systems that comprise a multi-stage turbine apparatus to generate energy from fluid expansion.

A number of industrial processes create heat as a byproduct. In some circumstances, this heat energy is considered "waste" heat that is dissipated to the environment. Exhausting or otherwise dissipating this "waste" heat generally hinders the recovery of this heat energy for conversion into other useful forms of energy, such as electrical energy.

SUMMARY

In some embodiments, a turbine generator apparatus may include an electric generator having a stator and a rotor. The turbine generator apparatus may also include a first turbine wheel coupled to a first end of the rotor to rotate at the same speed as the rotor. The first turbine wheel may be configured to receive a working fluid into an inlet side of the first turbine wheel and output the working fluid from an outlet side of the first turbine wheel, and rotate in response to expansion of the working fluid flowing from the inlet side to the outlet side of the first turbine wheel. The turbine generator apparatus may also include a second turbine wheel coupled to a second end of the rotor, opposite the first end of the rotor, to rotate at the same speed as the rotor. The second turbine wheel may be configured to receive the working fluid into an inlet side of the second turbine wheel and output the working fluid from an outlet side of the second turbine wheel, and rotate in response to expansion of the working fluid flowing from the inlet side to the outlet side of the second turbine wheel.

In some embodiments, a generator system for use in a Rankine cycle may include a liquid reservoir for a working fluid of the Rankine cycle. The system may also include a pump device coupled to the liquid reservoir to receive the working fluid from the liquid reservoir and an evaporator heat exchanger also coupled to the pump device to receive the working fluid from the pump and apply heat to the working fluid. The system also includes a turbine generator apparatus coupled to the evaporator heat exchanger to receive the working fluid from the evaporator heat exchanger and configured to generate electrical energy in response to expansion of the working fluid. The turbine generator apparatus may include an electric generator having a stator and a rotor. The turbine generator apparatus may also include a first turbine wheel coupled to a first end of the rotor to rotate at the same speed as the rotor. The first turbine wheel may be configured to receive a working fluid into an inlet side of the first turbine wheel and output the working fluid from an outlet side of the first turbine wheel, and rotate in response to expansion of the working fluid flowing from the inlet side to the outlet side of the first turbine wheel. The turbine generator apparatus also includes a second turbine wheel coupled to a second end of the rotor, opposite the first end of the rotor, to rotate at the same speed as the rotor. In certain instances, the second turbine wheel may be configured to receive the working fluid into an inlet side of the second turbine wheel and output the working fluid from an outlet side of the second turbine wheel and rotate in response to expansion of the working fluid flowing from the inlet side to the outlet side of the second turbine wheel. The system also may include as part of the Rankine cycle a condenser heat exchanger coupled to the turbine generator apparatus to receive the working fluid from the turbine generator apparatus and extract heat from the working fluid.

In some embodiments, a method of circulating a working fluid through a working cycle may include vaporizing the working fluid. The method may also include receiving at least a part of the vaporous working fluid into an inlet side of a first turbine wheel and an inlet side of a second turbine wheel. The first and second turbine wheels may be rotated in response to expansion of the working fluid through the turbine wheels, and in turn may rotate a rotor of a generator at the same speed as the first and second turbine wheels. The method may also include outputting the working fluid from an outlet side of the first turbine wheel and an outlet side of the second turbine wheel, and condensing the working fluid to a liquid.

In certain instances of the embodiments, the first turbine wheel is configured to receive the working fluid radially into the inlet side of the first turbine wheel and output the working fluid axially from the outlet side of the first turbine wheel.

In certain instances of the embodiments, the second turbine wheel is configured to receive the working fluid radially into an inlet side of the second turbine wheel and output the working fluid axially from the outlet side of the second turbine wheel.

In certain instances of the embodiments, the first turbine wheel may be configured to direct at least part of the working fluid from the outlet side of the first turbine wheel through the electric generator.

In certain instances of the embodiments, the second turbine wheel may be configured to direct the at least part of the working fluid from the outlet side of the second turbine wheel through the electric generator.

In certain instances of the embodiments, the inlet side of the second turbine wheel is proximate the electric generator, the apparatus further comprising a conduit configured to direct the at least part of the working fluid from an outlet of the electric generator to the inlet side of the second turbine wheel.

In certain instances of the embodiments, the electric generator is arranged proximate the inlet side of the first turbine wheel.

In certain instances of the embodiments, the electric generator is arranged proximate the inlet side of the second turbine wheel.

In certain instances of the embodiments, the second turbine wheel is configured to receive the working fluid into the inlet side of the second turbine wheel from the outlet side of the first turbine wheel.

In certain instances of the embodiments, the rotor is directly coupled to the first turbine wheel.

In certain instances of the embodiments, the apparatus is configured so that the first turbine wheel receives the same working fluid as the second turbine wheel.

In certain instances of the embodiments, the rotor and the turbine wheel are coupled to rotate together without a gear box.

In certain instances of the embodiments, the electric generator may include at least one magnetic bearing supporting the rotor relative to the stator.

In certain instances of the embodiments, the first turbine wheel is configured to receive the working fluid radially into the inlet side of the first turbine wheel and output the working fluid axially from the outlet side of the first turbine wheel.

In certain instances of the embodiments, the Rankine cycle is an organic Rankine cycle.

In certain instances of the embodiments, receiving the vaporous working fluid into an inlet of the first turbine wheel may include receiving the vaporous working fluid into a radial inlet of the first turbine wheel and outputting the working fluid from an outlet side of the first turbine wheel comprises outputting the working fluid axially from the outlet side of the first turbine wheel.

In certain instances of the embodiments, rotating the rotor may include rotating a shaft common to the first turbine wheel and the rotor.

In certain instances of the embodiments, the shaft is connected to the second turbine wheel.

In certain instances of the embodiments, the first and second turbine wheels are affixed directly to the rotor.

DETAILED DESCRIPTION

A turbine generator apparatus generates electrical energy from rotational kinetic energy derived from expansion of a gas through a turbine wheel. For example, rotation of the turbine wheel can be used to rotate a magnetic rotor within a stator, which then generates electrical energy. The generator resides on the inlet side of the turbine wheel, and in certain instances is isolated from contact with the gas.

Figure 1:
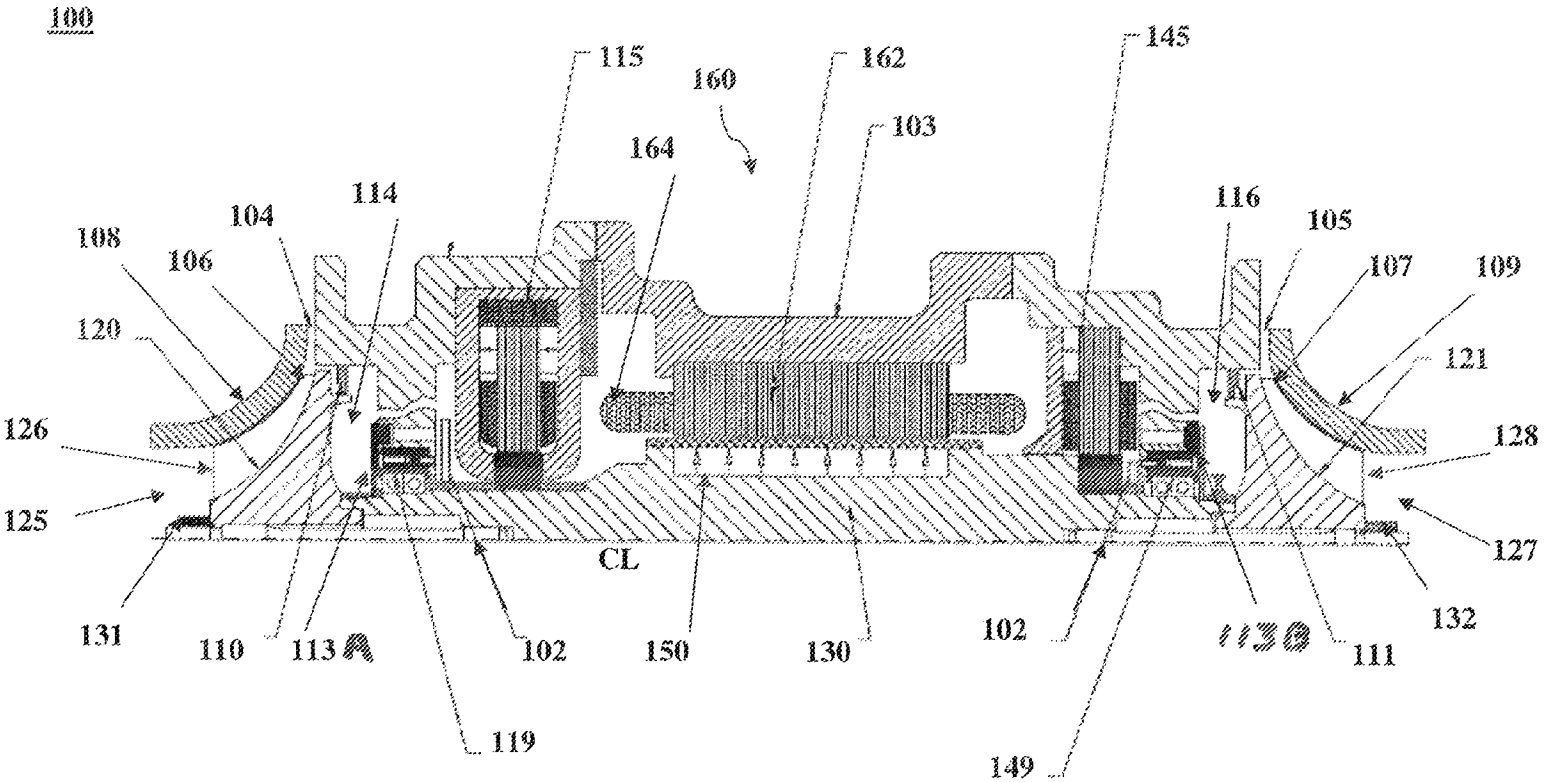
FIG. 1 is a cross-sectional view of a turbine generator apparatus in accordance with the present disclosure.

Referring to FIG. 1, an electric power generation system may comprise a turbine generator apparatus 100 in which electricity is generated from expansion of a working fluid. The turbine generator apparatus 100 can be part of a closed system, such as a Rankine cycle, organic Rankine cycle or the like, in which a pressurized and heated working fluid is permitted to expand and release energy in the turbine generator apparatus 100. The turbine generator apparatus of FIG. 1 includes two expander stages (e.g., turbine expander stages), each of which rotates upon expansion of the working fluid flowing from its inlet side to its outlet side. For example, the heated and pressurized working fluid may enter the turbine generator apparatus 100 through a first inlet conduit 104, and after expanding, exit the turbine generator apparatus 100 through a first outlet conduit 125. Likewise, the working fluid may enter the turbine generator apparatus 100 through a second inlet conduit 105, and after expanding, exit the turbine generator apparatus 100 through a second outlet conduit 127.

The turbine wheel 120 is shown as a radial inflow turbine wheel configured to rotate as the working fluid expands through the turbine wheel 120. The working fluid flows from the inlet conduit 104 into a radial inlet 106 of the turbine wheel 120, and flows from an axial outlet 126 of the turbine wheel 120 to the outlet conduit 125. The turbine wheel 120 is contained in a turbine housing 108. In certain instances, the turbine wheel 120 is a shrouded turbine wheel. In other embodiments, the shroud can be omitted and the turbine wheel 120 can substantially seal against the interior of the turbine housing 108. Different configurations of turbine wheels can be used. For example, in embodiments, the turbine wheel may be an axial inflow turbine having either a radial or axial outlet. In addition, the turbine wheel may be single-stage or multi-stage. The turbine wheel 120 is coupled to a rotor 130 of a generator 160. As such, the turbine wheel 120 is driven to rotate by the expansion of the working fluid, and in turn, the rotor 130 (including the magnets 150) rotates in response to the rotation of the turbine wheel 120.

The turbine generator apparatus 100 of FIG. 1 also includes a turbine wheel 121, also illustrated as a radial inflow turbine wheel, though other configurations are contemplated by this disclosure. The turbine wheel 121 is configured to rotate as the working fluid expands through the turbine wheel 121. The working fluid may flow from an inlet conduit 105 into a radial inlet 107 of the turbine wheel 121, and flows from an axial outlet 128 of the turbine wheel 121 to the outlet conduit 127. Different configurations of turbine wheels can be used. For example, in embodiments, the turbine wheel may be an axial inflow turbine having either a radial or axial outlet. In addition, the turbine wheel may be single stage or multi-stage. The turbine wheel 121 is coupled to rotor 130. As such, the turbine wheel 121 is driven to rotate by the expansion of the working fluid, and in turn, the rotor 130 (including the magnets 150) rotates in response to the rotation of the turbine wheel 121 If working fluid is expanded through both turbine wheels 120 and 121, the turbine wheels 120 and 121 can cooperate to rotate the rotor 130.

The turbine generator apparatus 100 of FIG. 1 shows the outlets 126 and 128 configured to direct the working fluid away from the rotor 130, with the inlet conduits 104 and 105 residing next to or proximate the generator 160. In certain embodiments, one or both of the turbine wheels 120 or 121 could be oriented such that its respective inlet conduit 104 or 105 resides away from the generator 160 and its respective outlet conduit 125 or 127 is next to or in fluid communication with the generator 160. Further, outlet conduit 125 may be in fluid communication with inlet conduit 105 to direct the working fluid from the outlet conduit 125 of turbine wheel 120 to the inlet conduit 105 of turbine wheel 121 (e.g., by directing the working fluid or some part thereof through the generator or by directing the working fluid or some part thereof around the generator).

In some embodiments, the working fluid (or some part of the working fluid) is directed from the outlet of a turbine wheel into the generator. The working fluid may pass through the generator before entering the inlet of the second turbine wheel. In certain instances of the embodiments, the turbine may include a flow diverter to redirect the flow from the generator to a radial inlet of the turbine for radial inflow turbine wheels. Alternatively, the turbine wheel may be an axial turbine wheel and may receive the working fluid from the electric generator. The working fluid may cool the generator or parts of the generator, such as the rotor and/or the stator.

In certain instances, one or both of the turbine wheels 120 and 121 are directly affixed to the rotor 130, or to an intermediate common shaft 102, for example, by fasteners, rigid drive shaft, welding, or other manner. For example, the turbine wheel 120 may be received over an end of the rotor 130, and held to the rotor 130 with a shaft 102. The shaft 102 threads into the rotor 130 at one end, and at the other, captures the turbine wheel 120 between the end of rotor 130 and a nut 131 and 132 threadingly received on the shaft 102. The turbine wheel 120 and rotor 130 are coupled without a gearbox and rotate at the same speed. In other instances, the turbine wheel 120 can be indirectly coupled to the rotor 130, for example, by a gear train, clutch mechanism, or other manner.

Turbine housings 108 and 109 are affixed to a generator casing 103 that contains the rotor 130, as well as a stator 162 of the generator 160. Circumferential seals 110 and 111 are provided to seal between the turbine wheels 120 and 121 and the interior of the casing 103. Seals 110 and 111 provide leakage control and contribute to thrust balance. In some embodiments, a pressure in cavities 114 and 116 may be applied to balance thrust. Pressure may be applied using a balance piston or by other techniques known to those of skill in the art. In addition, tight shaft seals 113A and 113B are provided to prevent passage of working fluid in and around the turbine wheels 120 and 121, respectively, into the interior of the generator 160. The shaft seals 113A and 113B isolate the rotor 130 and the stator 162 from contact with the working fluid, and may be disposed between cavities 114 and 116, respectively, and the generator 160.

As shown in FIG. 1, bearings 115 and 145 are arranged to rotatably support the rotor 130 and turbine wheel 120 relative to the stator 162, and the generator casing 103. The turbine wheel 120 is supported in a cantilevered manner by the bearings 115 and 145. In embodiments, the turbine wheel 120 may be supported in a non-cantilevered manner and bearings 119 and 149 may be located on the outlet side of turbine wheels 120 and 121. In certain instances, one or more of the bearings 115 or 145 can include ball bearings, needle bearings, magnetic bearings, foil bearings, journal bearings, or others. The bearings 115 and 145 need not be the same types of bearings. In certain instances, the bearings 115 and 145 comprise magnetic bearings. U.S. Pat. No. 6,727,617 assigned to Calnetix, Inc. describes bearings suitable for use as bearings 115 and 145. Bearing 115 is a combination radial and thrust bearing, supporting the rotor 130 in radial and axial directions. Bearing 145 is a radial bearing, supporting the rotor 130 radially. Other configurations could be utilized.

In the embodiments in which the bearings 115 and 145 are magnetic bearings, the turbine generator apparatus 100 may include one or more backup bearings. For example, at start-up and shut down or in the event of a power outage that affects the operation of the magnetic bearings 115 and 145, first and second backup bearings 119 and 149 may be employed to rotatably support the turbine wheel 120 during that period of time. The first and second backup bearings 119 and 149 may comprise ball bearings, needle bearings, journal bearings, or the like. In certain instances, the first backup bearing 119 includes ball bearings that are arranged near the first magnetic bearing 115. Also, the second backup bearing 149 includes ball bearings that are arranged near the second magnetic bearing 145. Thus, in certain instances, even if the first and second bearings 115 and 145 temporarily fail (e.g., due to an electric power outage or other reason), the first and second backup bearings 119 and 149 would continue to support the turbine wheels 120 and 121 and the rotor 130.

The turbine generator apparatus 100 is configured to generate electricity in response to the rotation of the rotor 130. In certain instances, the rotor 130 can include one or more permanent magnets 150. The stator 162 includes a plurality of conductive coils. Electrical current is generated by the rotation of the magnet 150 within the coils of the stator 162. The rotor 130 and stator 162 can be configured as a synchronous, permanent magnet, multiphase AC generator. In certain instances, stator 162 may include coils 164. When the rotor 130 is rotated, a voltage is induced in the stator coil 164. At any instant, the magnitude of the voltage induced in coils 164 is proportional to the rate at which the magnetic field encircled by the coil 164 is changing with time (i.e., the rate at which the magnetic field is passing the two sides of the coil 164). In instances where the rotor 130 is coupled to rotate at the same speed as the turbine wheel 120, the turbine generator apparatus 100 is configured to generate electricity at that speed. Such a turbine generator apparatus 100 is what is referred to as a "high speed" turbine generator.

Figure 2:
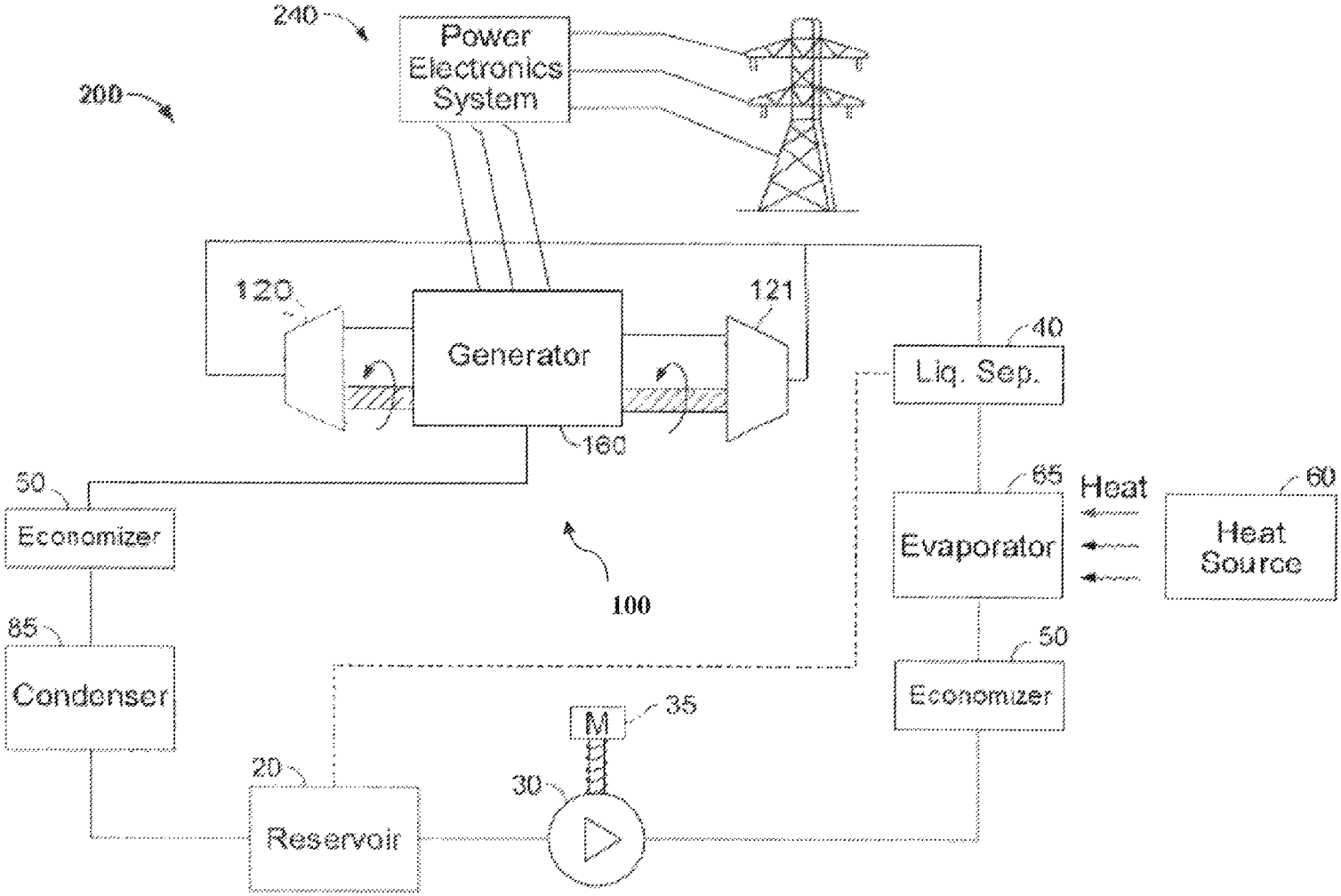
FIG. 2 is a schematic of an electrical power generation system incorporating a turbine generator apparatus, in accordance with the present disclosure.

Referring now to FIG. 2, embodiments of the turbine generator apparatus 100 can be used in a Rankine cycle 200 that recovers waste heat from one or more industrial processes. For example, the Rankine cycle 200 may comprise an organic Rankine cycle that employs an engineered working fluid to receive waste heat from a separate process. In certain instances, the working fluid may be a refrigerant (e.g., an HFC, CFC, HCFC, ammonia, water, or other refrigerant), such as, for example, R245fa. As such, the turbine generator apparatus 100 can be used to recover waste heat from industrial applications and then to convert the recovered waste heat into electrical energy. Furthermore, the heat energy can be recovered from geo-thermal heat sources and solar heat sources. In some circumstances, the working fluid in such a Rankine cycle 200 may comprise a high molecular mass organic fluid that is selected to efficiently receive heat from relatively low temperature heat sources. Although the turbine generator apparatus 100 and other components are depicted in the Rankine cycle 200, it should be understood from the description herein that some components that control or direct fluid flow are excluded from view in FIG. 2 merely for illustrative purposes.

In certain instances, the turbine generator apparatus 100 can be used to convert heat energy from a heat source into kinetic energy (e.g., rotation of the rotor), which is then converted into electrical energy. For example, the turbine generator apparatus 100 may output electrical power that is configured by a power electronics package to be in form of 3-phase 60 Hz power at a voltage of about 400 VAC to about 480 VAC. Alternative embodiments may output electrical power having other selected settings. In certain instances, the turbine generator apparatus 100 may be configured to provide an electrical power output of about 2 MW or less, about 50 kW to about 1 MW, and about 100 kW to about 300 kW, depending upon the heat source in the cycle and other such factors. Again, alternative embodiments may provide electrical power at other power outputs. Such electrical power can be transferred to a power electronics system and, in certain instances, to an electrical power grid system.

The Rankine cycle 200 may include a pump device 30 that pumps the working fluid. The pump device 30 may be coupled to a liquid reservoir 20 that contains the working fluid, and a pump motor 35 can be used to operate the pump. The pump device 30 may be used to convey the working fluid to an evaporator heat exchanger 65 of the Rankine cycle 200. Evaporator heat exchanger 65 may receive heat from a heat source 60. As shown in FIG. 2, the heat source 60 may include heat that is recovered from a separate process (e.g., an industrial process in which heat is byproduct). Some examples of heat source 60 include commercial exhaust oxidizers (e.g., a fan-induced draft heat source bypass system, a boiler system, or the like), refinery systems that produce heat, foundry systems, smelter systems, landfill flare gas and generator exhaust, commercial compressor systems, solar heaters, food bakeries, geo-thermal sources, solar thermal sources, and food or beverage production systems. In such circumstances, the working fluid may be directly heated by the separate process or may be heated in a heat exchanger in which the working fluid receives heat from a byproduct fluid of the process. In certain instances, the working fluid can cycle through the heat source 60 so that all or a substantial portion of the fluid is converted into gaseous state. Accordingly, the working fluid is heated by the heat source 60.

Typically, working fluid at a low temperature and high pressure liquid phase from the pump 30 is circulated into one side of the economizer 50 while working fluid at a high temperature and low pressure vapor phase is circulated into another side of the economizer 50 with the two sides being thermally coupled to facilitate heat transfer therebetween. Although illustrated as separate components, the economizer 50 may be any type of heat exchange device, such as, for example, a plate and frame heat exchanger or a shell and tube heat exchanger or other device.

The evaporator heat exchanger 65 may also be a plate and frame heat exchanger. The evaporator may receive the working fluid from the economizer 50 at one side and receive a supply thermal fluid at another side, with the two sides of the evaporator heat exchanger 65 being thermally coupled to facilitate heat exchange between the thermal fluid and working fluid. For instance, the working fluid enters the evaporator heat exchanger 65 from the economizer 50 in liquid phase and is changed to a vapor phase by heat exchange with the thermal fluid supply. The evaporator heat exchanger 65 may be any type of heat exchange device, such as, for example, a shell and tube heat exchanger or other device.

Liquid separator 40 may be arranged upstream of the turbine generator apparatus 100 so as to separate and remove a substantial portion of any liquid state droplets or slugs of working fluid that might otherwise pass into the turbine generator apparatus 100. Accordingly, in certain instances of the embodiments, the gaseous state working fluid can be passed to the turbine generator apparatus 100, while a substantial portion of any liquid-state droplets or slugs are removed and returned to the reservoir 20. In certain instances of the embodiments, a liquid separator may be located between turbine stages (e.g., between the first turbine wheel and the second turbine wheel) to remove liquid state droplets or slugs that may form from the expansion of the working fluid from the first turbine stage. This liquid separator may be in addition to the liquid separator located upstream of the turbine apparatus.

Referring briefly to FIG. 1, after passing through the liquid separator 40, the heated and pressurized working fluid may pass through the inlet conduit 104 and toward the turbine wheel 120 and may pass through the inlet conduit 105 and toward turbine wheel 121. The working fluid expands as it flows across the turbine wheels 120 and 121, thereby acting upon the turbine wheels 120 and 121 and causing rotation of the turbine wheels 120 and 121. Accordingly, the turbine generator apparatus 100 can be included in a fluid expansion system in which kinetic energy is generated from expansion of the working fluid. The rotation of the turbine wheels 120 and 121 are translated to the rotor 130 which, in certain instances, includes the magnet 150 that rotates within an electrical generator device 160. As such, the kinetic energy of the turbine wheels 120 and 121 is used to generate electrical energy. The electrical energy output from the electrical generator device 160 can be transmitted via one or more connectors (e.g., three connectors may be employed in certain instances). As mentioned above in connection to FIG. 2, in certain instances, the working fluid may be directed through the generator 160 and output to the economizer 50. In some instances, such as that illustrated in FIG. 3A, the working fluid may expand as it passes through turbine wheel 320 causing turbine wheel 320 to rotate before it enters the generator 397. The working fluid may then be directed to turbine wheel 321 from generator 397, where it may expand causing turbine wheel 321 to rotate. For example, the working fluid may pass through a gap between the rotor 130 and the stator 162 within the generator housing 103. The working fluid may cool the generator 160 (or in FIG. 3A, generator 397).

Referring to FIG. 2, in certain instances, the electrical energy can be communicated via the connectors to a power electronics system 240 that is capable of modifying the electrical energy. In one example, the power electronics system 240 may be connected to an electrical power grid system. As previously described, in certain instances, the turbine generator apparatus 100 may be configured to provide an electrical power output of about 2 MW or less, about 50 kW to about 1 MW, and about 100 kW to about 300 kW, depending upon the heat source 60, the expansion capabilities of the working fluid, and other such factors. In certain instances, the electrical energy output by the turbine generator apparatus 100 can be supplied directly to an electrically powered facility or machine.

In certain instances of the Rankine cycle 200, the working fluid may flow from the outlet conduit 109 of the turbine generator apparatus 100 to a condenser heat exchanger 85. The condenser heat exchanger 85 is used to remove heat from the working fluid so that all or a substantial portion of the working fluid is converted to a liquid state. In certain instances, a forced cooling airflow or water flow is provided over the working fluid or the condenser heat exchanger 85 to facilitate heat removal. After the working fluid exits the condenser heat exchanger 85, the fluid may return to the liquid reservoir 20 where it is prepared to flow again though the cycle 200. In certain instances, the working fluid exits the generator 160 (or in some instances, exits a turbine wheel) and enters the economizer heat exchanger 50 before entering the condenser 85, as described above.

In some embodiments, the working fluid returned from the condenser heat exchanger 85 enters the reservoir 20 and is then pressurized by the pump 30. The working fluid is then circulated to the cold side of the economizer 50, where heat therefrom is transferred to the working fluid (e.g., from the hot side to the cold side of the economizer 50). Working fluid exits the cold side of the economizer 50 in liquid phase and is circulated to an evaporator (not shown), thereby completing or substantially completing the thermodynamic cycle.

Figure 3A:
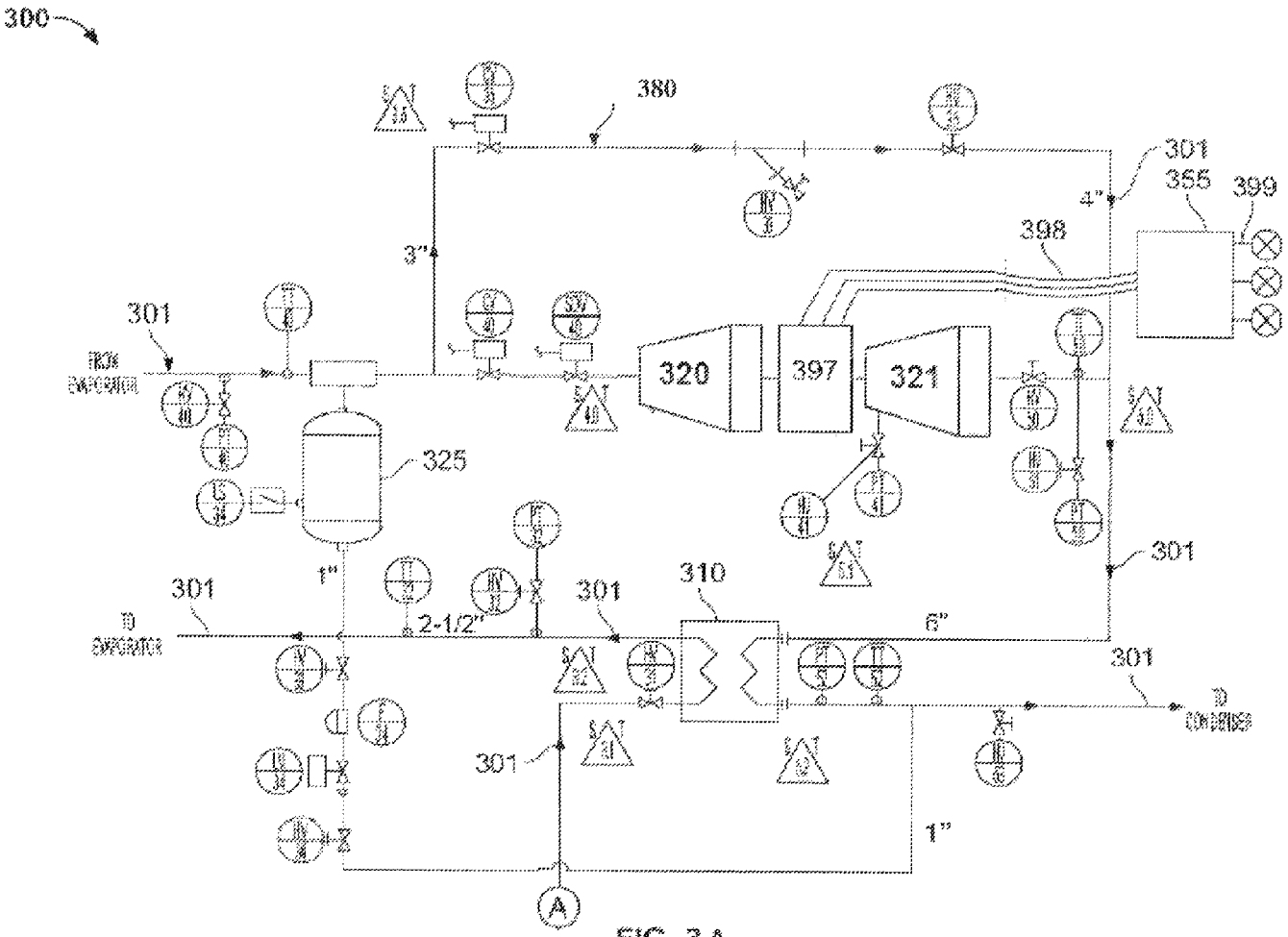
FIG. 3A is a schematic of a closed loop cycle incorporating a turbine generator apparatus in accordance with the present disclosure.
Figure 3B:
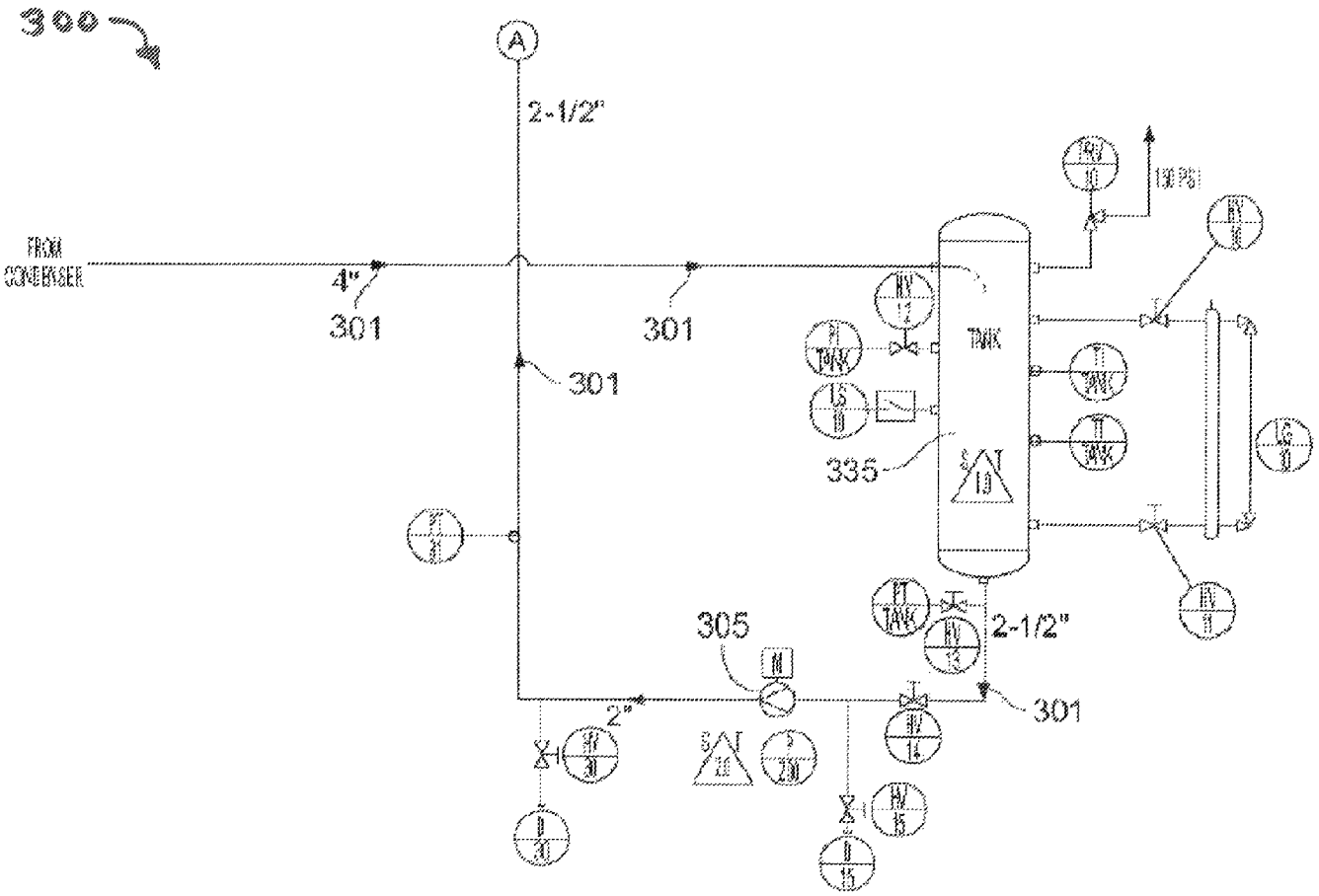
FIG. 3B is a continuation of the schematic of FIG. 3A showing a closed loop cycle incorporating a turbine generator apparatus in accordance with the present disclosure.

FIGS. 3A-B illustrate an example process diagram showing one example of a power generation system 300. FIG. 3A continues onto FIG. 3B, where point Ⓐ of FIG. 3A connects to point Ⓐ of FIG. 3B. As illustrated, the process diagram of FIGS. 3A-B may include more detail and show more components (e.g., sensors such as temperature and pressure sensors or transducers ("PT" and "TT"); valves such as control valves ("CV"), solenoid operated valves ("SOV") and hand valves ("HV"); fittings; or other components) as compared to FIG. 2. Although some components of power generation system 300 are shown as single components, the present disclosure contemplates that each single component may be multiple components performing identical or substantially identical functions (e.g., reference to economizer 310 encompasses references to multiple economizers). Likewise, although some components of power generation system 300 are shown as multiple components, the present disclosure contemplates that multiple, identical components may be a single component performing the identical or substantially identical functions as the multiple components (e.g., reference to turbine expander 320 encompasses reference to a single turbine expander 320).

Power generation system 300 includes a working fluid pump 305, an economizer 310, a first turbine expander 320 coupled to a generator 397, a second turbine expander 321 coupled to generator 397, a receiver 335, and power electronics 355. A working fluid 301 circulates through the components of power generation system 300 in a thermodynamic cycle (e.g., a closed Rankine cycle) to drive the turbine expanders 320 and 321 and generate AC power 398 by the generator 397. The power generation system 300 may utilize a thermal fluid (e.g., a fluid heated by waste heat, a fluid heated by generated heat, or any other heated fluid) to drive one or more turbine expanders by utilizing a closed (or open) thermodynamic cycle to generate electrical power. In some embodiments, each turbine expander 320 and 321 may capable of rotating at rotational speeds up to 26,500 rpm or higher to drive a generator (as a component of or electrically coupled to the turbine expander 320) producing up to 125 kW or higher AC power. AC power 399 may be at a lower frequency, a higher or lower voltage, or both a lower frequency and higher or lower voltage relative to AC power 398. For instance, AC power 399 may be suitable for supplying to a grid operating at 60 Hz and between 400-480V.

In operation, power generation system 300 circulates a working fluid 301 through the turbine expander 320 to drive (i.e., rotate) the turbine expander 320. Turbine expander 320 drives the generator 397, which generates AC power 398. The generator 397 may output the working fluid through turbine expander 321 to rotate turbine expander 321. The working fluid 301 exhausts from the turbine expander 321 and, typically, is in vapor phase at a relatively lower temperature and pressure. In some embodiments, the working fluid may be directed through turbine expanders 320 and 321, which both output the working fluid 301 to generator 397. The working fluid exhausts from the generator and continues through the cycle.

The economizer 310, as illustrated, is a plate and frame heat exchanger that is fluidly coupled with the outlet of the pump 305 and an inlet of the condenser. Typically, working fluid 301 at a low temperature and high pressure liquid phase from the pump 305 is circulated into one side of the economizer 310 while working fluid 301 at a high temperature and low pressure vapor phase (from an exhaust header) is circulated into another side of the economizer 310 with the two sides being thermally coupled to facilitate heat transfer therebetween. Although illustrated as a plate and frame heat exchanger, the economizer 310 may be any other type of heat exchange device, such as, for example, a shell and tube heat exchanger or other device.

The evaporator (not shown) may also be a plate and frame heat exchanger. The evaporator heat exchanger may receive the working fluid 301 from the economizer 310 at one side and receive a supply thermal fluid at another side, with the two sides of the evaporator heat exchanger being thermally coupled to facilitate heat exchange between the thermal fluid and working fluid 301. For instance, the working fluid 301 enters the evaporator heat exchanger from the economizer 310 in liquid phase and is changed to a vapor phase by heat exchange with the thermal fluid supply. The evaporator heat exchanger may be any type of heat exchange device, such as, for example, a shell and tube heat exchanger or other device.

Liquid separator 325 may be arranged upstream of the turbine 320 so as to separate and remove a substantial portion of any liquid-state droplets or slugs of working fluid that might otherwise pass into the turbine 320. Accordingly, the gaseous state working fluid can be passed to the turbine 320 while a substantial portion of any liquid-state droplets or slugs are removed and returned to the receiver 335 via the condenser heat exchanger.

Working fluid 301 enters the economizer 310 at both sides of the economizer 310 (i.e., the hot and cold sides), where heat energy is transferred from the hot side working fluid 301 (i.e., vapor phase) to the cold side working fluid 301 (i.e., liquid phase). The working fluid 301 exits the hot side of the economizer 310 to a condenser heat exchanger (not shown) as vapor. The working fluid 301 returns from the condenser heat exchanger in liquid phase, having undergone a phase change from vapor to liquid in the condenser by, for example, convective heat transfer with a cooling medium (e.g., air, water, or other gas or liquid).

The working fluid 301 returned from the condenser enters the receiver 335 and is then pressurized by the pump 305. The working fluid 301 is then circulated to the cold side of the economizer 310, where heat therefrom is transferred to the working fluid 301 (e.g., from the hot side to the cold side of the economizer 310). Working fluid 301 exits the cold side of the economizer 310 in liquid phase and is circulated to an evaporator (not shown), thereby completing or substantially completing the thermodynamic cycle.

In the illustrated embodiment, the power generation system 300 includes a bypass 380, which allows vapor working fluid 301 to bypass the turbine expander 320 and merge into an exhaust of the turbine expander 320. In some embodiments, this may allow for better and/or more exact control of the power generation system 300 and, more particularly, for example, to maintain an optimum speed of the turbine expander 320. In addition, the bypass permits system cleaning and emergency disconnect capabilities.

Figure 4:
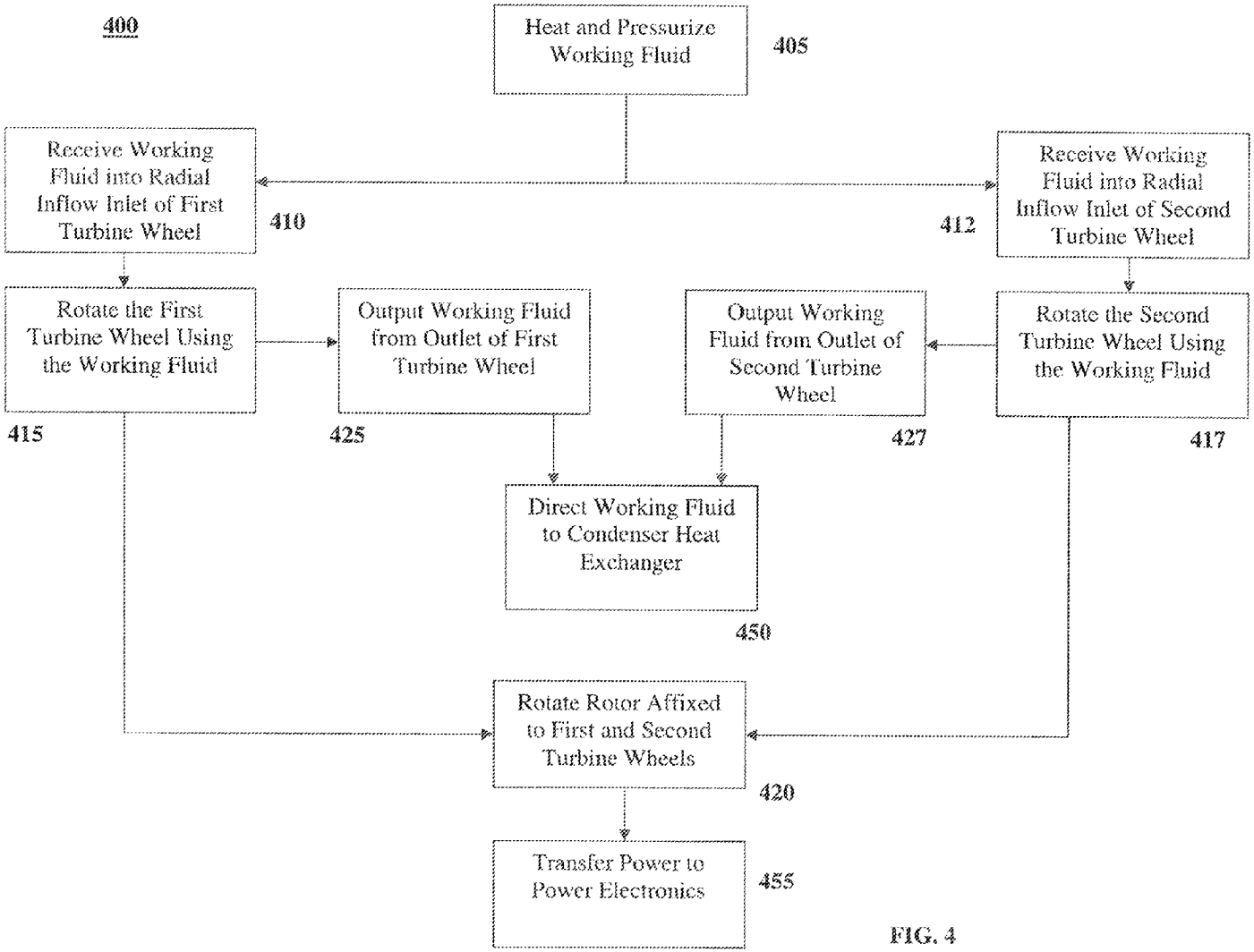
FIG. 4 is a process flow diagram showing one example operation of a turbine generator consistent with the present disclosure.

FIG. 4 is a process flow diagram 400 showing example steps to generate electrical energy from the turbine generator apparatus of the present disclosure. Steps of process flow diagram 400 are shown in a certain order, but it is to be understood by those of skill in the art that the order of the steps may be changed or added to without deviating from the scope of the disclosure. A working fluid is directed from a reservoir by a pump to an evaporator heat exchanger (405). The evaporator heat exchanger may receive heat from a heat source, such as a waste heat application. In certain instances, the working fluid may be directed to the heat source without going through the heat exchanger. Heated and pressurized working fluid is directed to a turbine generator apparatus. In certain instances, the working fluid is directed to a first radial inflow turbine wheel (410). The working fluid may enter the first turbine wheel radially, expanding as it passes through the turbine wheel, and exit the turbine wheel axially. Other turbine wheel configurations may also be used. For example, the working fluid may be directed into the turbine wheel of a multi-stage turbine axially and output therefrom axially or radially. As the working fluid passes through the first turbine wheel, the first turbine wheel rotates (415). In certain instances, the first turbine wheel is affixed to a rotor of a generator device, which rotates with the turbine wheel (420). The rotor may be directly connected to the first turbine wheel by a common shaft, and may rotate at the same speed as the turbine wheel. In embodiments, the rotor and the turbine wheel may be magnetically coupled. In certain instances, the working fluid enters the turbine wheel proximate an inlet side and is output from the turbine wheel away from the generator device (425). In certain instances the working fluid can be output from the turbine wheel and directed to pass through the generator device. The working fluid may directed to a condenser heat exchanger (450). Rotation of the rotor may be used to generate power, which is transferred to power electronics (455), which can modify and control the power output to a grid.

The working fluid may also be directed to a second turbine wheel (412). In certain instances, the working fluid is directed to a radial inflow turbine wheel. The working fluid may enter the second turbine wheel radially, expanding as it passes through the turbine wheel, and exit the turbine wheel axially. Other turbine wheel configurations may also be used. For example, the working fluid may be directed into the turbine wheel of a multi-stage turbine axially and output therefrom axially or radially. As the working fluid passes through the second turbine wheel, the first turbine wheel rotates (417). In certain instances, the second turbine wheel is affixed to the rotor of a generator device, on the opposite side of the rotor from the first turbine wheel, and rotates with the first and second turbine wheel (420). As mentioned above, rotation of the rotor of the rotor may be used to generate power, which is transferred to power electronics (455), which can modify and control the power output to a grid. The second turbine wheel may output the working fluid axially from the turbine wheel (427). In certain instances, the second turbine wheel outputs the working fluid radially. The working fluid may be directed to the condenser heat exchanger, as described above (420). In certain instances the working fluid may flow through the generator before flowing to the condenser heat exchanger.

Figure 5:
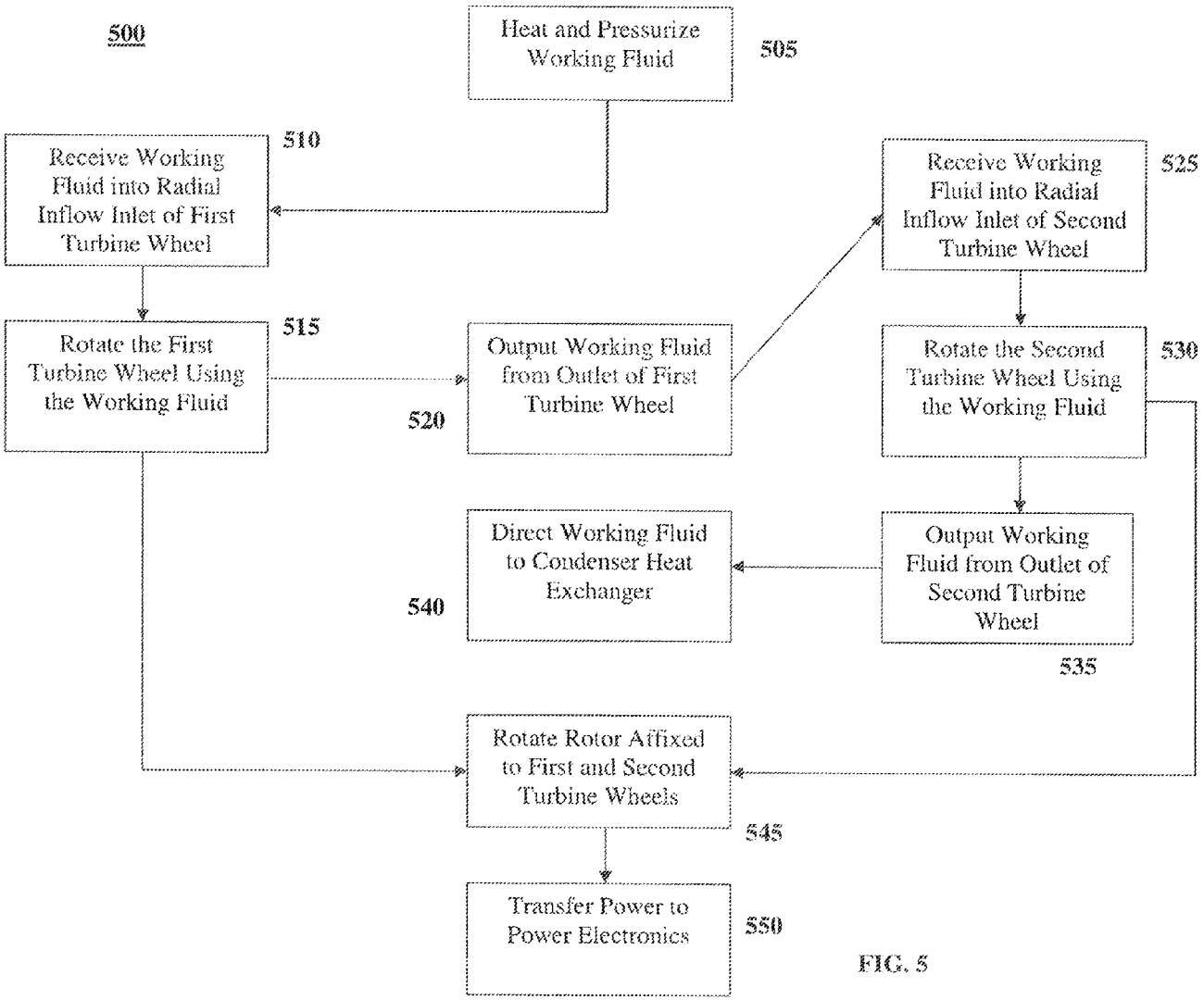
FIG. 5 is an alternate process flow diagram showing one example operation of a turbine generator consistent with the present disclosure.

FIG. 5 is a process flow diagram 500 of another example of steps used to generate energy from a working cycle system of the present disclosure. Working fluid is heated and pressurized (505). The working fluid may be heated and pressurized using an evaporator heat exchanger or in a manner similar to that described in FIG. 4. The working fluid may be directed to a radial inlet of a first radial inflow turbine wheel (510). In certain instances, the inlet may be located next to or proximate an electric generator, the generator having a stator and a rotor. The rotor is coupled to the first turbine wheel. The working fluid expands as it passes through the first turbine wheel and rotates the first turbine wheel (515). The rotation of the first turbine wheel rotates a rotor affixed there to (545). The working fluid may be output from an axial outlet of the first turbine wheel (520). The working fluid may be directed to and received by a radial inlet of a second radial inflow turbine wheel (525). The working fluid expands as it passes through the second turbine wheel, rotating the second turbine wheel (530). The rotation of the second turbine wheel rotates the rotor affixed there to (545). The second turbine wheel is located on an opposite side of the rotor than the first turbine wheel. The working fluid may be output from an axial outlet of the second turbine wheel (535), and directed to a condenser heat exchanger in the closed loop working cycle (540). The power generated by the rotation of the rotor may be transferred to power electronics (550) or directly to the grid.

Figure 6:
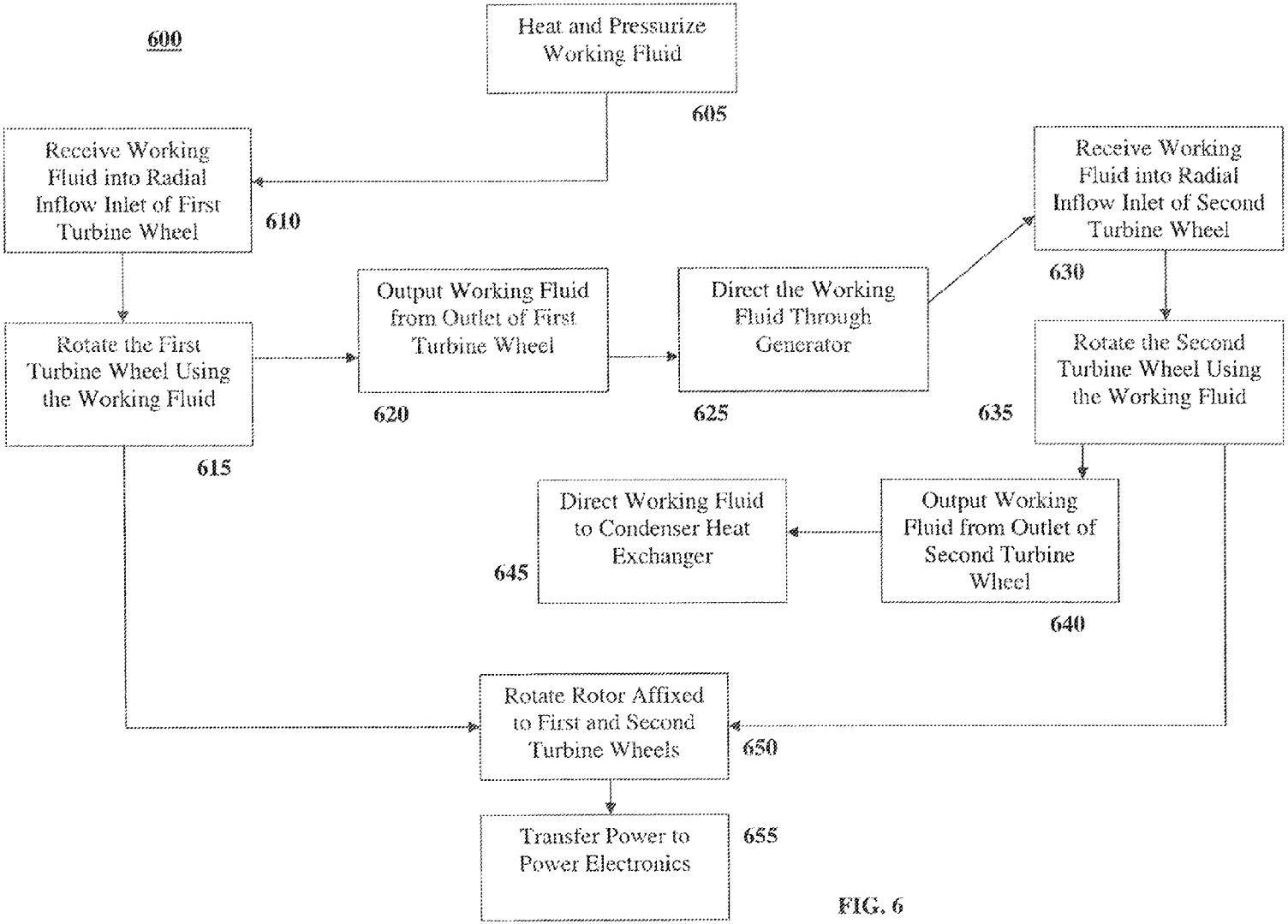
FIG. 6 is another alternate process flow diagram showing one example operation of a turbine generator consistent with the present disclosure

FIG. 6 is a process flow diagram 600 showing steps for generating energy using a turbine generator apparatus. In FIG. 6, the working fluid may be heated and pressurized in a similar manner as described above (605). The working fluid may be directed to a first turbine wheel (610), and expands as it passes through the first turbine wheel. As the working fluid expands, it rotates the first turbine wheel (615), which in turn rotates a rotor affixed there to (650). The working fluid may be output from the first turbine wheel (620) and directed to the electric generator (625). The working fluid may pass through the generator to cool the rotor and stator. In certain instances, the working fluid may pass through the generator but may be isolated from the rotor portion of the generator. The working fluid may be directed from the generator to an inlet of a second turbine wheel (630), which is coupled to the rotor opposite from the first turbine generator. The second turbine wheel rotates as the working fluid passes through it (635), which in turn rotates the rotor (650). The working fluid may then be outputted from the second turbine wheel (640). The working fluid may then be directed back into the closed loop working cycle, where it is directed to a condenser heat exchanger (645). The power generated by the rotation of the rotor may transferred to power electronics (655) or directly to the grid.

A number of embodiments of the disclosure have been described. Nevertheless, it will be understood that various modifications may be made without departing from the spirit and scope of the disclosure. Accordingly, other embodiments are within the scope of the following claims.

What is claimed is:

1. An apparatus comprising:

an electric generator having a stator and a rotor;

a first turbine having a first turbine wheel coupled to a first end of the rotor to rotate at the same speed as the rotor and configured to receive working fluid into an inlet side of the first turbine wheel and output working fluid from an outlet side of the first turbine wheel and rotate in response to expansion of working fluid flowing from the inlet side to the outlet side of the first turbine wheel, wherein the first turbine is in fluid communication with the electric generator to direct working fluid from the outlet side of the first turbine wheel in direct contact with the electric generator to cool the electric generator; and a second turbine having a second turbine wheel coupled to a second end of the rotor, opposite the first end of the rotor, to rotate at the same speed as the rotor and configured to receive working fluid into an inlet side of the second turbine wheel and output working fluid from an outlet side of the second turbine wheel and rotate in response to expansion of working fluid flowing from the inlet side to the outlet side of the second turbine wheel, wherein the electric generator is arranged proximate the outlet side of the second turbine wheel.

2. The apparatus of claim 1 wherein the first turbine wheel is configured to receive working fluid radially into the inlet side of the first turbine wheel and output working fluid axially from the outlet side of the first turbine wheel.

3. The apparatus of claim 2 wherein the second turbine wheel is configured to receive working fluid radially into the inlet side of the second turbine wheel and output working fluid axially from the outlet side of the second turbine wheel.

4. The apparatus of claim 1 wherein the second turbine wheel is configured to direct working fluid from the outlet side of the second turbine wheel in direct contact with the electric generator.

5. The apparatus of claim 1 wherein the electric generator is arranged proximate the inlet side of the first turbine wheel.

6. The apparatus of claim 1 wherein the second turbine wheel is configured to receive working fluid into the inlet side of the second turbine wheel from the outlet side of the first turbine wheel.

7. The apparatus of claim 1 wherein the rotor is directly coupled to the first turbine wheel.

8. The apparatus of claim 1 wherein the rotor and the turbine wheel are coupled to rotate together without a gear box.

9. The apparatus of claim 1 wherein the apparatus further comprises at least one magnetic bearing supporting the rotor relative to the stator.

10. The apparatus of claim 1 wherein the apparatus is configured so that the first turbine wheel receives the same working fluid as the second turbine wheel.

11. The apparatus of claim 1 wherein the first turbine is configured to direct working fluid from the outlet side of the first turbine wheel through a gap between the stator and the rotor of the electric generator.

12. The apparatus of claim 1 wherein the first turbine is configured to direct working fluid from the outlet side of the first turbine wheel through the electric generator into the inlet side of the second turbine wheel.

13. A generator system for use in an organic Rankine cycle, comprising:

a liquid reservoir for a working fluid of the organic Rankine cycle;

a pump device coupled to the liquid reservoir to receive the working fluid from the liquid reservoir;

an evaporator heat exchanger coupled to the pump device to receive the working fluid from the pump and apply heat to the working fluid;

a turbine generator apparatus coupled to the evaporator heat exchanger to receive the working fluid from the evaporator heat exchanger and configured to generate electrical energy in response to expansion of the working fluid, the turbine generator apparatus comprising:

an electric generator having a stator and a rotor, a first turbine having a first turbine wheel coupled to a first end of the rotor to rotate at the same speed as the rotor and configured to receive a working fluid into an inlet side of the first turbine wheel and output the working fluid from an outlet side of the first turbine wheel and rotate in response to expansion of the working fluid flowing from the inlet side to the outlet side of the first turbine wheel, wherein the first turbine is in fluid communication with the electric generator to direct at least part of the working fluid from the outlet side of the first turbine wheel in direct contact with the electric generator to cool the electric generator, and a second turbine having a second turbine wheel coupled to a second end of the rotor, opposite the first end of the rotor, to rotate at the same speed as the rotor, wherein the second turbine wheel is in fluid communication with the electric generator to receive the at least part of the working fluid from an outlet of the electric generator to an inlet side of the second turbine wheel; and a condenser heat exchanger coupled to the turbine generator apparatus to receive the working fluid from the turbine generator apparatus and extract heat from the working fluid.

14. The system of claim 13 wherein the first turbine wheel is configured to receive the working fluid radially into the inlet side of the first turbine wheel and output the working fluid axially from the outlet side of the first turbine wheel.

15. The system of claim 13 wherein the electric generator is arranged proximate the inlet side of the first turbine wheel.

16. The system of claim 13 wherein the rotor is directly coupled to the first turbine wheel.

17. The system of claim 13 wherein the second turbine wheel is configured to receive the working fluid into the inlet side of the second turbine wheel and output the working fluid from an outlet side of the second turbine wheel and rotate in response to expansion of the working fluid flowing from the inlet side to the outlet side of the second turbine wheel.

18. A method of circulating a working fluid through a working cycle, comprising:

vaporizing the working fluid;

receiving the vaporous working fluid into an inlet side of a first turbine wheel;

rotating the first turbine wheel in response to expansion of the working fluid through the first turbine wheel, and in turn rotating a rotor of an electric generator at the same speed as the first turbine wheel;

outputting the working fluid from an outlet side of the first turbine wheel;

receiving the working fluid from the outlet side of the first turbine wheel into an inlet side of a second turbine wheel disposed in a second turbine;

rotating the second turbine wheel in response to expansion of the working fluid through the second turbine wheel, and in turn rotating the rotor at the same speed as the second turbine wheel;

cooling the electric generator by directing at least part of the working fluid from an outlet side of the second turbine wheel in direct contact with the electric generator using the second turbine; and condensing the working fluid to a liquid.

19. The method of claim 18 wherein receiving the vaporous working fluid into the inlet of the first turbine wheel comprises receiving the vaporous working fluid into a radial inlet of the first turbine wheel and outputting the working fluid from the outlet side of the first turbine wheel comprises outputting the working fluid axially from the outlet side of the first turbine wheel.

20. The method of claim 18 wherein rotating the rotor comprises rotating a shaft common to the first turbine wheel and the rotor.

21. The method of claim 20 wherein the shaft is connected to the second turbine wheel.

22. The method of claim 20 wherein the first and second turbine wheels are affixed directly to the rotor.

23. The method of claim 18 wherein the working cycle is an organic Rankine working cycle.

24. The method of claim 18 wherein the electric generator is arranged proximate the inlet side of the first turbine wheel and the electric generator is arranged proximate the outlet side of the second turbine wheel.

* * * * *